United States Patent [19]

Nozato

[11] Patent Number: 5,046,476

[45] Date of Patent: Sep. 10, 1991

[54] SUPPORT STRUCTURE FOR BALL THROWING MACHINE

[75] Inventor: Fujio Nozato, Osaka, Japan

[73] Assignee: Toa Sports Machines Co., Ltd., Osaka, Japan

[21] Appl. No.: 473,799

[22] Filed: Feb. 2, 1990

[30] Foreign Application Priority Data

Sep. 1, 1989 [JP] Japan ..... 1-227964

[51] Int. Cl.[5] ..... F41B 4/00

[52] U.S. Cl. ..... 124/78; 273/26 D

[58] Field of Search ..... 124/78, 80, 81, 83; 273/26 D

[56] References Cited

U.S. PATENT DOCUMENTS

| | | | |
|---|---|---|---|
| 4,203,413 | 5/1980 | Hodges | 124/78 |
| 4,323,048 | 4/1982 | Saito et al. | 124/80 X |
| 4,423,717 | 1/1984 | Kahelin | 124/78 |
| 4,531,504 | 7/1985 | Gilreath | 124/78 |
| 4,583,514 | 4/1986 | Nozato | 124/78 |
| 4,632,088 | 12/1986 | Bruce | 124/78 |
| 4,712,534 | 12/1987 | Nozato . | |
| 4,760,835 | 8/1988 | Paulson et al. | 124/80 X |
| 4,823,763 | 4/1989 | Ponza | 124/78 |

FOREIGN PATENT DOCUMENTS 7605989 12/1977 Netherlands .

*Primary Examiner*—Peter M. Cuomo

*Attorney, Agent, or Firm*—Armstrong, Nikaido, Marmelstein, Kubovcik & Murray

[57] ABSTRACT

A pair of front rotary wheels are disposed so that they hold therebetween a frame extending in the direction in which a ball is thrown. A pair of rear rotary wheels are disposed rearwardly of the front rotary wheels and with the frame held therebetween. These front and rear rotary wheels are operatively connected together by operatively connecting devices. When a ball is fed in from the rear end of the frame, it is nipped between the outer peripheral surfaces of the pair of rear rotary wheels and thrown forward and then it is nipped between the outer peripheral surfaces of the front rotary wheels and thrown forward. An annular bracket is fitted on the frame in its intermediate portion between the front and rear rotary wheels and is attached to the frame. The annular bracket are pivotally supported at its right and left outer sides on the support block, and the operatively connecting devices are disposed within the annular bracket. -

5 Claims, 4 Drawing Sheets

34a
3
22
11
12
30
21
1
29
31
32
40
9
39'
30
10
39
23
23
8
2
35
26
30
35
41
34a
34a
24
30
25
11
12'
4
38
44
44
46
45
45
43
37
5

SUPPORT STRUCTURE FOR BALL THROWING MACHINE

BACKGROUND OF THE INVENTION

This invention relates to a ball throwing machine used for practicing batting and catching balls, and particularly it relates to a support structure for such ball throwing machine.

To make it possible to pitch balls at high speed, some of such ball throwing machines have heretofore been constructed in the following manner.

A pipe serving as a frame extends in the ball throwing direction. A pair of front rotary wheels are disposed with said pipe held therebetween, while a pair of rear rotary wheels are disposed behind said front rotary wheels and with said pipe held therebetween. These front and rear rotary wheels are operatively connected together by V-belt wrapping connector type operatively connecting means. Further, the front and rear ends of said pipe are supported by brackets on a support block.

And when a ball is fed into said pipe at its rear end, the ball is nipped between the outer peripheral surfaces of said pair of rear rotary wheels and thereby pitched forward and then said ball is nipped between the outer peripheral surfaces of said pair of front rotary wheels and accelerated and pitched forward.

In the arrangement described above, the front and rear ends of the pipe are supported by brackets on a support block; the provision of brackets at two places makes the ball throwing machine heavier by the corresponding amount.

This type of ball throwing machine is equipped with a pair of front rotary wheels and a pair of rear rotary wheels, tending to increase the overall size of the machine. Besides this, the provision of respective brackets at the front and rear ends of the pipe makes the size of the ball throwing machine extremely large.

Further, in the above arrangement, since the V-belt wrapping connector type operatively connecting means is exposed to the outside, the V-belts can get caught by something else during transport and are thereby easily damaged.

For these reasons, said ball throwing machine is difficult to handle during transport.

SUMMARY OF THE INVENTION

A first object of the invention is to decrease the weight of the ball throwing machine, make the ball throwing machine compact and to prevent the operatively connecting means from interfering with something else to make it easier to handle the ball throwing machine during transport.

A second object of the invention is to construct the operatively connecting means simply and at low cost.

A third object of the invention is to give sufficient strength to the ball throwing machine and make it easier to produce the ball throwing machine.

A fourth object of the invention is to provide a variety of baseball pitches by utilizing an annular bracket.

BRIEF DESCRIPTION OF THE DRAWINGS

The drawings show a preferred embodiment of the invention.

DESCRIPTION OF THE PREFERRED EMBODIMENTS

Figure 1:
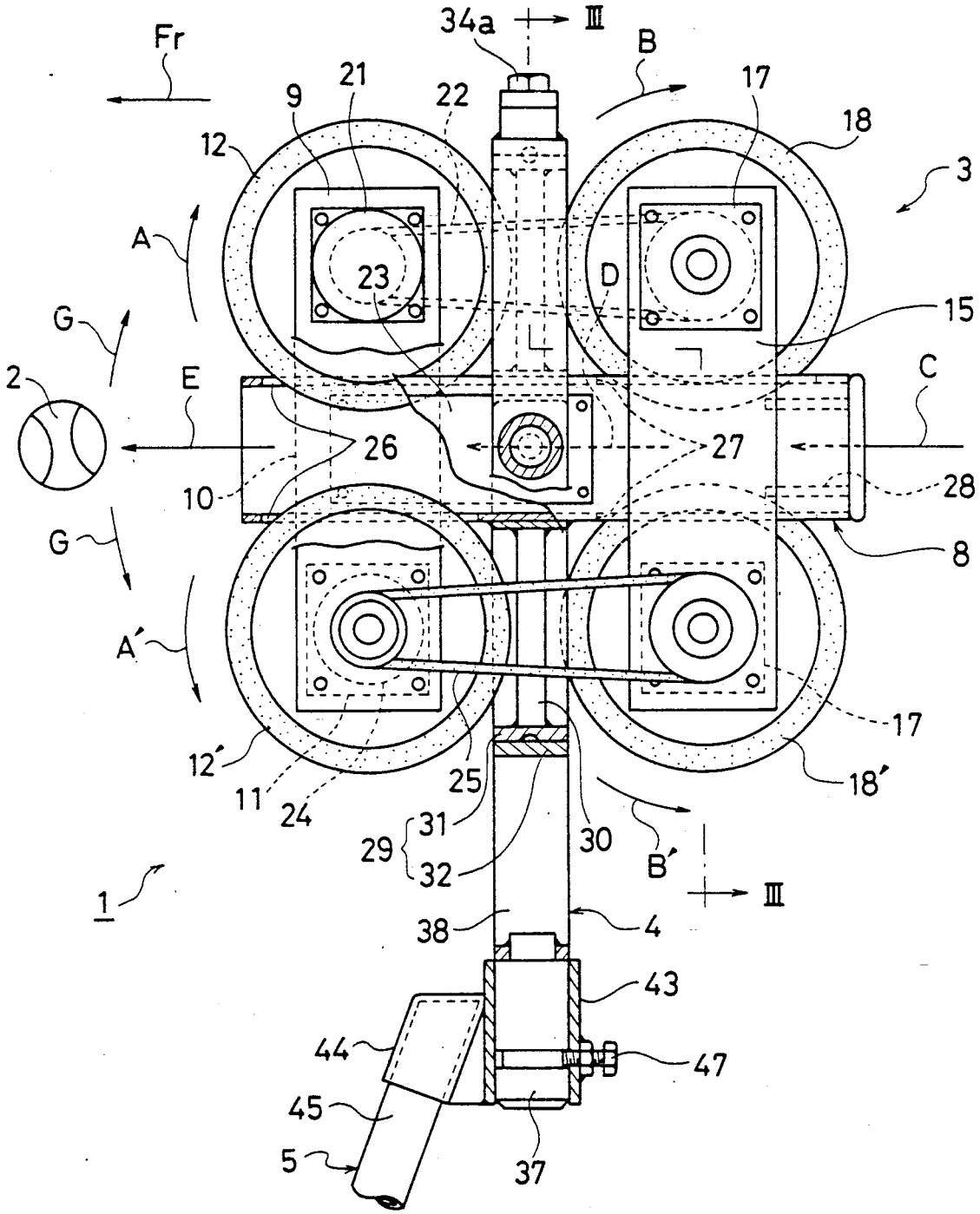
FIG. 1 is a side view, partly in section.

In the drawings, the numeral 1 denotes a ball throwing machine having a ball throwing machine body 3 for throwing a ball 2 forward, said ball throwing machine body 3 being supported on a support block 5 through a support member or bracket 4. In addition, the arrow Fr indicates the direction of travel of a ball thrown by the ball throwing machine 1.

The ball throwing machine body 3 has a ball throwing pipe 8 which is a frame extending in the ball throwing direction, said pipe having a square cross-section. The left-hand side surface (as viewed in the ball throwing direction; any direction mentioned herein is determined on the basis of the ball throwing direction) of the front portion of said ball throwing pipe 8 has a front left-hand support plate 9 attached thereto, while the right-hand side surface of the front portion of said ball throwing pipe 8 has a front right-hand support plate 10. On the upper and lower portions of said front left-hand and right-hand support plates 9 and 10, a pair of vertically spaced front rotary wheels 12 and 12' are supported by bearings 11, said front rotary wheels 12 and 12' being disposed to hold the front portion of said ball throwing pipe 8 therebetween from above and below.

The left-hand side surface of the rear portion of said ball throwing pipe 8 has a rear left-hand support plate 15 attached thereto, while the right-hand side surface of the rear portion of said ball throwing pipe 8 has a rear right-hand support plate 16 attached thereto. And on the upper and lower portions of said rear left-hand and right-hand support plates 15 and 16, a pair of vertically spaced rear rotary wheels 18 and 18' are supported by bearings 17, said rear rotary wheels 18 and 18' being disposed to hold the rear portion said ball throwing pipe 8 therebetween from above and below.

The front and rear rotary wheels 12, 12', 18 and 18' have their outer peripheral surfaces formed of an elastic material of high friction coefficient, such as rubber; they are all of the same size and shape and of the same weight, and their central axes of rotation are parallel to each other and orthogonal to the ball throwing direction.

The upper portion of said front left-hand support plate 9 has an upper electric motor 21 attached thereto, said upper electric motor 21 being coaxial with the upper front rotary wheel 12 and adapted to rotate said front rotary wheel 12 in the direction of arrow A in FIG. 1. The upper rear rotary wheel 18 is operatively connected to said front rotary wheel 12 by upper V-belt wrapping connector means 22. In this case, the rear rotary wheel 18 is rotated in the same direction as that of the front rotary wheel 12 as indicated by arrow B, but at a lower speed than that of the front rotary wheel 12.

On the other hand, the lower portion of said front right-hand support plate 10 has a lower electric motor 24 attached thereto, said lower electric motor 22 being coaxial with the lower front rotary wheel 12' and adapted to rotate said front rotary wheel 12' in the direction opposite to that for the upper front rotary wheel 12, that is, in the direction of arrow A' in FIG. 1. The lower rear rotary wheel 18' is operatively connected to said front rotary wheel 12' by lower V-belt wrapping connector means 25. In this case, the rear rotary wheel 18' is rotated in the same direction as that of the front rotary wheel 12' as indicated by arrow B, but at a lower speed than that of the front rotary wheel 12'.

The opposed peripheral surfaces of said upper rotary wheels 12 and 12' extend through front openings 26 formed in the upper and lower surfaces of the ball throwing pipe 8 and are disposed in the ball throwing pipe 8. Likewise, the opposed peripheral surfaces of said rear rotary wheels 18 and 18' also extend through rear openings 27 formed in the upper and lower surfaces of the ball throwing pipe 8 and are disposed in the ball throwing pipe 8.

The rear end of the ball throwing pipe 8 is provided with a guide 28 for guiding a ball, such as the one shown at 2, into the ball throwing pipe 8.

Figure 4:
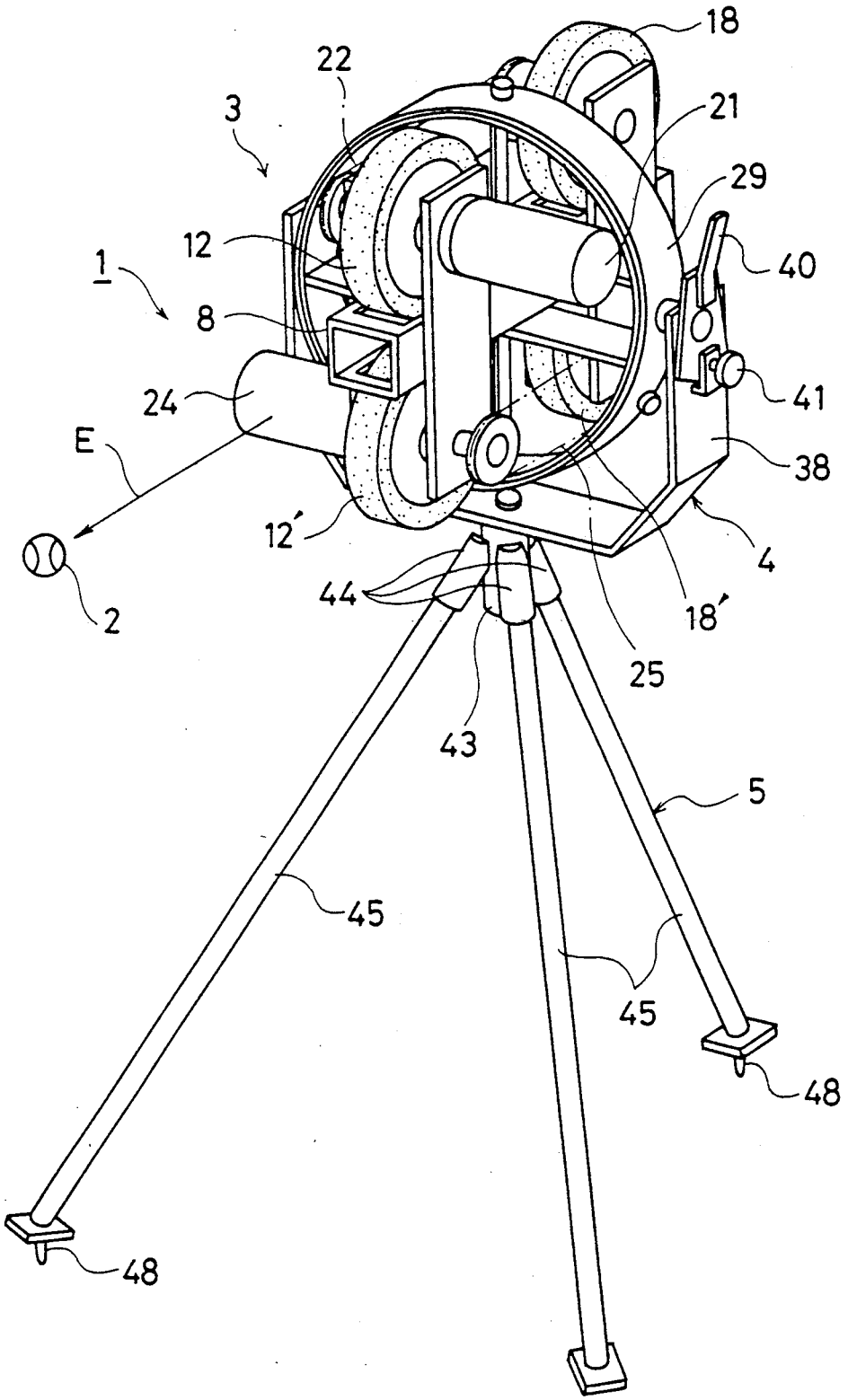
FIG. 4 is a perspective view of the entire structure.

And when a ball is fed into the ball throwing pipe 8 from its rear end through the guide 28 as indicated by arrow C in FIG. 1, the ball is nipped between the outer peripheral surfaces of the pair of rear wheels 18 and 18' and thrown forward as indicated by arrow D in FIG. 1. Further, the ball is then nipped between the outer peripheral surfaces of the pair of front rotary wheels 12 and 12' and thereby accelerated and thrown forward at high speed as indicated by arrow E in FIGS. 1 and 4.

In addition, the rotative speeds of the upper and lower electric motors 21 and 24 are controlled by electronic control means 23. Thus, the ball speed can be changed by changing motor speeds or a rotation can be imparted to the ball 2 by making motor speeds different from each other.

A description will now be given of the bracket 4.

The center of gravity of the ball throwing machine constructed in the manner described above is located between the front rotary wheels 12, 12' and the rear rotary wheels 18, 18' (see FIG. 1). An annular bracket 29 is fitted on the ball throwing pipe 8 in its intermediate region between the front rotary wheels 12, 12' and the rear rotary wheels 18, 18'. The annular bracket 29 comprises an inner ring 31 attached to the ball throwing pipe 8 by support plates 30 and an outer ring 32 having said inner ring 31 fitted therein.

Figure 3:
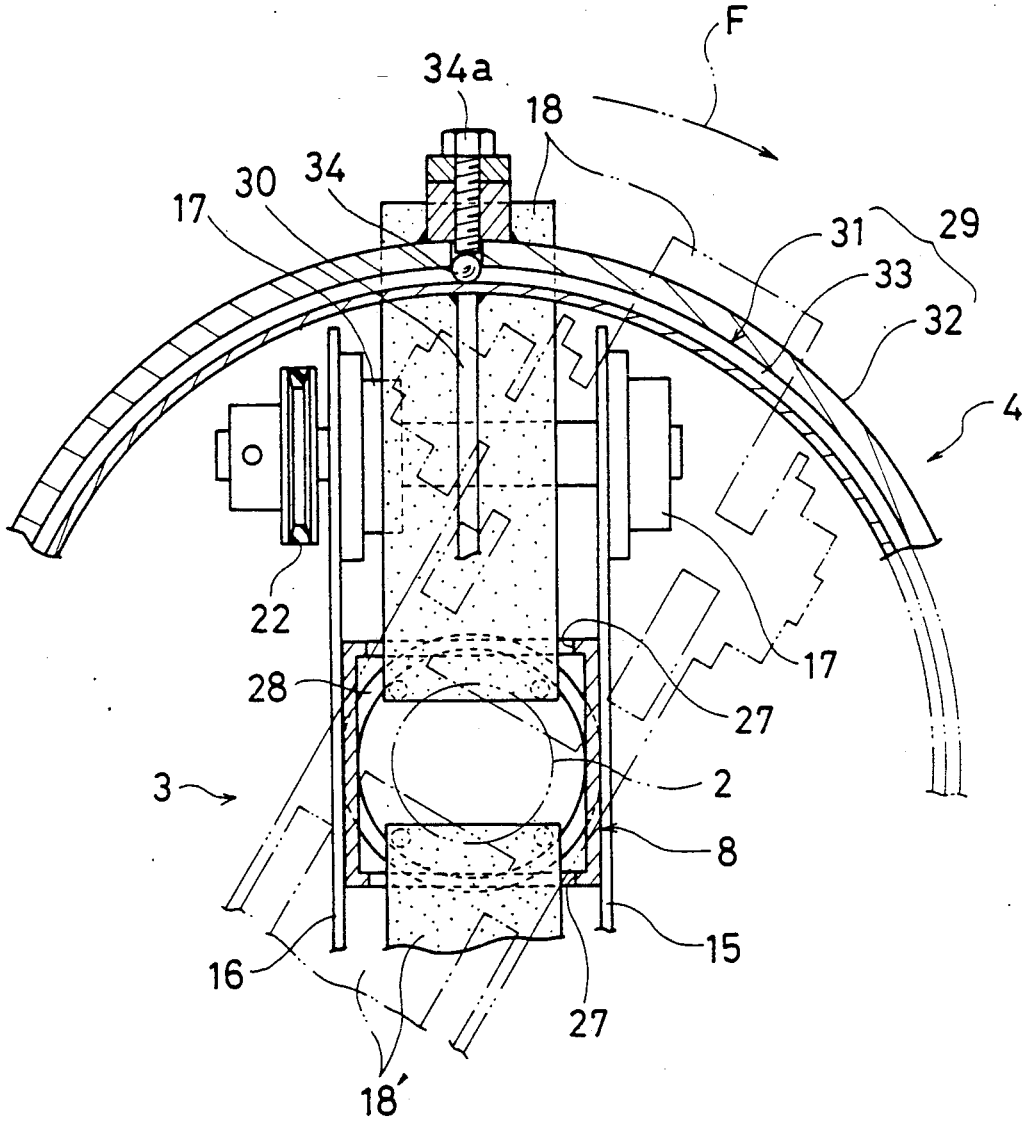
FIG. 3 is a view, partly in section, taken in the direction of arrow III—III in FIG. 1.

Particularly, as shown in FIG. 3, the outer peripheral surface of said inner ring 31 is formed with a peripheral groove 33 in which are partly fitted three balls 34 which are held in the outer ring 32. As a result, the inner and outer rings 31 and 32 are prevented from axially separating from each other but they are allowed to circumferentially rotate relative to each other. There are bolts **34*a* for holding said balls 34; when said bolts 34*a* are loosened, relative rotation of said inner and outer rings 31 and 32 as described above is allowed, and tightening the bolts prevents rotation thereof. Further, a pair of short arm pipes 35 extend from the right and left sides of said outer ring 32**.

The bracket 4 has a vertical pillar 37 and a support frame 38 of substantially U-shape as viewed in front view welded to the upper end of said pillar 37. At the left and right upper ends of said support frame 38, the projecting ends of said arm pipes 35 are supported by pivot shafts 39 and 39' for rotation around the axes of said arm pipes. In addition, the right-hand side pivot shaft 39' is removable from the associated arm pipe 35.

A turning lever 40 is removably attached to the pivot shaft 39, and a stop bolt 41 is provided for stopping said turning lever 40 in a desired angular position.

If the inner ring 31 is turned relative to the outer ring 32, the ball throwing machine body 3 can be turned together with the inner ring 31 to a desired angular position in the clockwise direction as indicated by arrow F and in phantom lines in FIG. 3 or in the counterclockwise direction; depending on the angle of inclination of the ball throwing machine body 3, such pitched balls as a curve and a slider can be obtained. The inner ring 31 can be turned through at least 180 degrees both clockwise and counterclockwise, respectively. It can also be turned through 360 degrees at least in one direction.

As a result, a variety of pitched balls can be obtained by utilizing the annular bracket 29 in the ball throwing machine 1.

If the turning lever 40 is turned forward or backward, the ball throwing machine body 3 can be tilted to a desired angular position; that is, a desired angle at which a ball is pitched can be selected. In addition, this turning lever 40 may be replaced by a worm gear device.

In the above case, the center of gravity of the ball throwing machine body 3 constructed of the ball throwing pipe 8 and the rotary wheels is located between the front rotary wheels 12, 12' and the rear rotary wheels 18, 18'.

Therefore, if the ball throwing machine 3 is supported at a position very close to its center of gravity rather than at the front and rear ends of the ball throwing pipe 8 at two points with respect to the support block 5, the ball throwing machine body 3 is firmly supported with respect to the support block 5.

Thus, in the embodiment of the invention, there is provided an annular bracket 29 fitted on the ball throwing pipe 8 in its intermediate region between the front rotary wheels 12, 12' and the rear rotary wheels 18, 18', and an annular bracket 29 is provided which is attached to the ball throwing pipe 8, said annular bracket 29 being supported at its right and left sides on said support block 5; that is, the ball throwing machine body 3 is supported at one point as seen in side view on the support block 5 through the annular bracket 29.

Since the ball throwing machine body 3 is supported at one point in this manner, weight reduction and compactness are attained by the amount corresponding to the removal of the brackets which are used to support the front and rear ends of the ball throwing pipe 8 in the conventional two-point support system.

Further, since the upper V-belt wrapping connector means 22 and lower V-belt wrapping connector means 25 for operatively connecting the front rotary wheels 12, 12' and rear rotary wheels 18, 18' are positioned within said annular bracket 29, these means are prevented by the annular bracket 29 from interfering with something else. Thus, such inconvenience as the upper and lower V-belt wrapping connector means 22 and 25 getting caught by something else and thereby damaged is avoided.

Thus, the handling to be performed during transport is facilitated.

Said V-belts have elasticity and can easily be damaged when contacted by something else. However, since said V-belts are protected by the annular bracket 29, such utilization of the V-belts can be attained without any trouble. Further, since such V-belts are simple in construction and at low cost, the use of V-belts makes it possible to construct operatively connecting means simply and at low cost.

Figure 2:
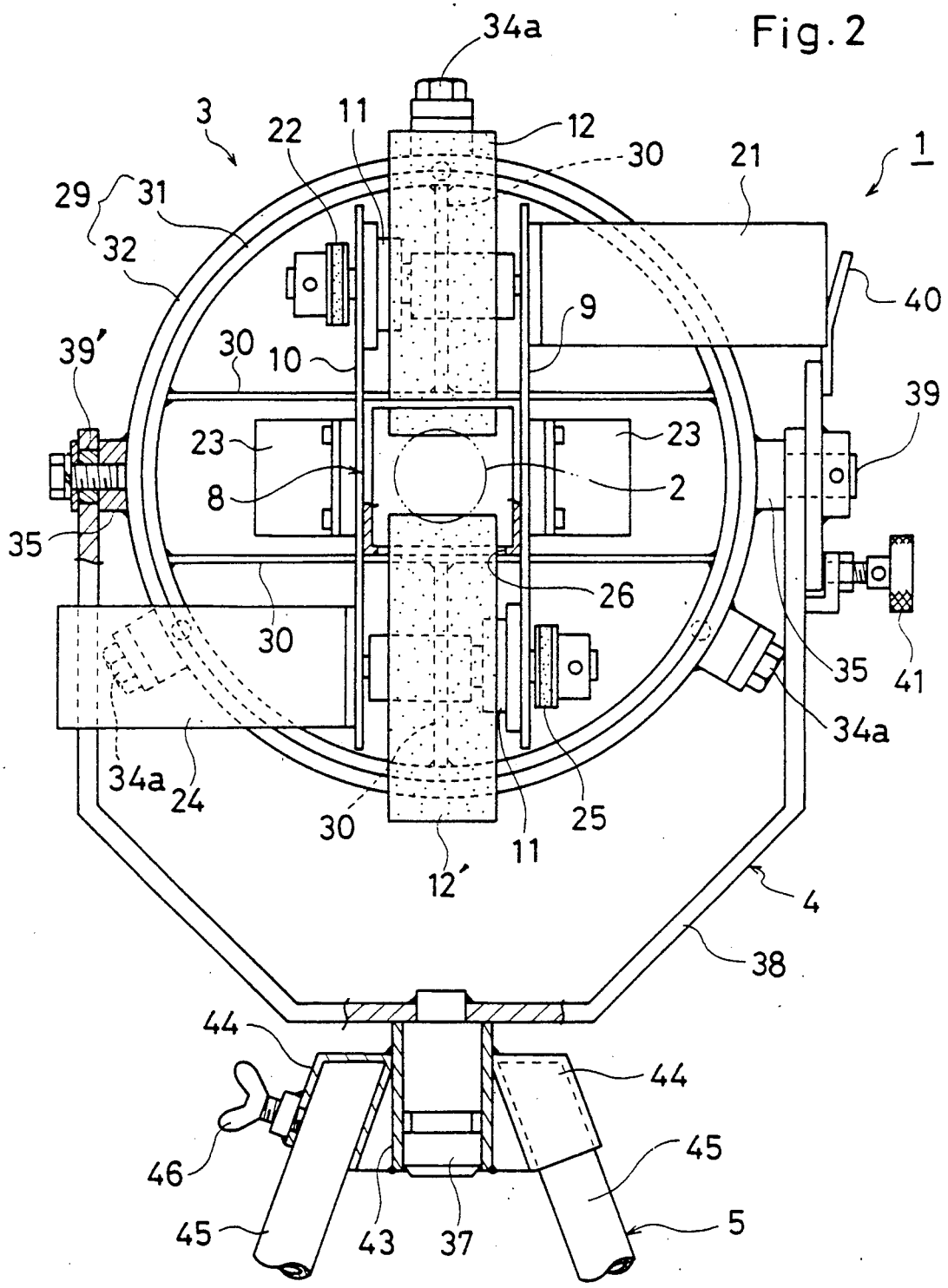
FIG. 2 is a front view, partly in section.

Particularly, as shown in FIGS. 1 and 2, said control means 23 also are disposed in the annular bracket 29 and fixed to the lateral surface of the ball throwing pipe 8 by screws. In other words, effective use is made of the free space in the annular bracket 29 to make the ball throwing machine compact. Further, according to the above arrangement, since the electric motors 21 and 24 are integrally turned, the electrical wiring which connect them together is prevented from being subjected to excessive force. Therefore, even if the inner ring 31 is turned through about 360 degrees, there is no electrical trouble.

The ball throwing pipe 8 is a square pipe having a square cross-section, such square pipe having sufficient rigidity. Thus, the ball throwing machine 1 has sufficient strength. Further, since operation for attaching parts to such square pipe is easier than to a round pipe, attachment of the annular bracket 29 to the ball throwing pipe 8 is facilitated; that is, the formation of the ball throwing machine 1 is facilitated.

A description will now be given of the support block 5.

The support block 5 has a support pipe 43 in which said pillar 37 is fitted for rotation around the axis of said support pipe 43. The support pipe 43 has three connecting pipes 44 welded thereto extending obliquely downward from said support pipe 43. Each connecting pipe 44 has a leg pipe 45 removably fitted therein and fixed thereto by a bolt 46. A stop bolt 47 extends through the support pipe 43 and is screwed into the pillar 37. Further, a spike 48 projects from the lower end of each leg pipe 45. When the support block 45 is installed on the ground, said spikes 48 are firmly fixed to prevent the leg pipes 45 from moving.

If the stop bolt 47 is loosened, the pillar 37 can be turned within the support pipe 43, such turning movement of the pillar 37 making it possible to turn the ball throwing machine body 3 to any desired angular position as seen in plan view. Further, tightening said stop bolt 47 fixes the pillar 37 to the support pipe 43. That is, the ball throwing machine body 3 can be fixed in position.

If bolts 46 are loosened, the leg pipes 45 can be removed from the connecting pipes 44.

Therefore, when it is desired to transport the ball throwing machine 1, the ball throwing machine body 3 and the bracket 4 are separated from each other 4 by removing the left-hand pivot shaft 39' from the associated arm pipe 35 and removing the turning lever 40 from the right-hand pivot shaft 39. And by loosening the bolts 46 and the stop bolts 44, the bracket 4 and the support block 5 are separated from each other and the connecting pipes 44 and the leg pipes 45 are separated from each other. These separated parts are all small in size, so that transport thereof is easy.

In addition, the description given above refers to the accompanying drawings; the operatively connecting means 22 and 25 may be flat belts. Further, the cross-section of the ball throwing pipe 8 may be rectangular or circular.

What is claimed is:

1. A support structure for a ball throwing machine including a frame extending in the ball throwing direction, a pair of front rotary wheels disposed with said frame held therebetween, a pair of rear rotary wheels disposed rearwardly of said pair of front rotary wheels and with said frame held therebetween, operatively connecting means for operatively connecting said front and rear rotary wheels, and a support block having a support member for supporting said frame, wherein a ball fed from the rear side of same frame is nipped between the outer peripheral surfaces of said pair of rear rotary wheels and thrown forward and then it is nipped between the outer peripheral surfaces of said pair of front wheels and thrown forward, said support structure being characterized in that it includes an annular bracket fitted on an intermediate portion of same frame between said front and rear rotary wheels and attached to said frame, said annular bracket being pivotally supported at its right and left sides by said support member and being composed of an inner ring coaxial with and attached to said frame and an outer ring pivotally supported by said support member and having said inner ring only circumferentially slidably fitted therein, said operatively connecting means being disposed within said annular bracket.

2. A support structure for a ball throwing machine as set forth in claim 1, wherein said operatively connecting means is V-belt wrapping connector means.

3. A support structure for a ball throwing machine as set forth in claim 1, wherein said frame is formed of a pipe having a square cross-section.

4. A support structure for a ball throwing machine as set forth in claim 1, 2 or 3, wherein said inner ring is turnable both clockwise and counterclockwise through about 180 degrees, respectively.

5. A support structure for a ball throwing machine as set forth in claim 1, 2 or 3, wherein said inner ring is turnable either clockwise or counterclockwise through about 360 degrees.

* * * * *